United States Patent [19]

Keller et al.

[11] 4,403,069

[45] Sep. 6, 1983

[54] FORMATION OF POLYMERIC FIBERS BY A SEEDING TECHNIQUE

[75] Inventors: L. Brian Keller, Palos Verdes Estates; Robert K. Jenkins, Huntington Beach; Gary Luster, Newbury Park, all of Calif.

[73] Assignee: Hughes Aircraft Company, El Segundo, Calif.

[21] Appl. No.: 270,719

[22] Filed: Jun. 5, 1981

Related U.S. Application Data

[63] Continuation of Ser. No. 973,403, Dec. 26, 1978, abandoned, which is a continuation-in-part of Ser. No. 707,585, Jul. 22, 1976, abandoned.

[51] Int. Cl.[3] ..... C08L 23/06; C08L 27/14

[52] U.S. Cl. ..... 525/197; 264/23; 264/140; 524/515; 524/520; 525/191; 525/200; 525/233; 525/240

[58] Field of Search ..... 524/515, 520; 525/191, 525/200, 222, 197, 233, 240; 264/23, 140

[56] References Cited

U.S. PATENT DOCUMENTS 4,054,625 10/1980 Roziowski et al. ..... 264/140
4,127,624 11/1978 Keller et al. ..... 264/23

*Primary Examiner*—J. Ziegler
*Attorney, Agent, or Firm*—A. W. Karambelas

[57] ABSTRACT

Polymeric fibers are formed from solution by the influence of polymeric seeding materials under conditions of simultaneous cooling and agitation.

9 Claims, No Drawings

FORMATION OF POLYMERIC FIBERS BY A SEEDING TECHNIQUE

RELATED APPLICATIONS

This application is a continuation of U.S. application Ser. No. 973,403, filed Dec. 26, 1978, now abandoned, which is a continuation-in-part of U.S. application Ser. No. 707,585, filed July 22, 1976, now abandoned.

BACKGROUND OF THE INVENTION

1. Field of the Invention

This invention relates to the preparation of polymeric fibers in general and to the formation of such fibers from solution in particular.

2. Prior Art

The formation of fibers from polymeric materials by spinning from a melt or from a highly viscous solution is old. These methods involve the initial formation of the fiber by a mechanical step such as extrusion through a spinnerette or drawing a fine continuous thread from the viscous melt. In the case of fiber formation from the molten material, the fibers are cooled and subsequently stretched and heat treated to develop desired mechanical properties. In fibers spun from highly concentrated solvent solutions, the solvent is removed by evaporation or extraction following the spinning step. They are then mechanically stretched and heat treated in the same manner as fibers formed from the melt.

In recent years, the formation of fibers by stirring very dilute solutions of certain polymers has been described in the scientific literature, Pennings, A. J., Vander Mack, et al. (Polymere, 99 (1969)). This procedure results in the formation of linear fibers attached to the stirrer. The fibers are non-uniformly distributed around the stirrer and are spirally arranged. The formation of similar fibers from stirred solutions has also been reported by A. Keller (Physics Today, May 1970, page 42). In addition, a crystalline material of fibrous shape having what is described as a "shish kebab" structure has been formed by irradiating a dilute solution of polyethylene in p-xylene with ultrasonics at 0.1 4 mW/cm from 85 to 190 Kilo HZ at a temperature of between 82° to 88° C. The concentration of polyethylene in the solvent ranged from 0.05 to 0.5% by weight and the fibers formed were sparse and very short (Blackadder and Schleinetz, nature 200, 788, 1963).

There is disclosed in U.S. Pat. No. 4,127,624 (Ser. No. 792,838, a division of Ser No. 616,747, abandoned) a process for generating unique masses of fibers from solutions of certain polymers by agitating the solutions at sonic frequencies. The fiber masses so formed consist of coherent, interconnected three dimensionally arrayed networks of very fine fibers. The method of forming fiber masses by sonic agitation of a cooling polymer solution was found to be useful with linear organic polymers, having a regularly repeated chain structure and a degree of crystallinity as determined by x-ray diffraction. The class of polymers described as polyalkenes are particularly amenable to fiber formation by the sonic agitation procedure. In general, isotactic polypropylene most readily formed fibers under these conditions and mixtures of isotactic polypropylene and other polyalkenes form fiber masses more readily than the polyalkenes alone. Non-crystalline polymers do not readily form fibers from solutions by the process disclosed in U.S. Pat. No. 4,127,624.

The ability to form dense fibrous masses from solution is highly desirable, particularly if the solute is a curable polymer or a curable polymer may be infiltrated into the mass after it is formed. This capability would facilitate the fabrication of superior solid encapsulants for complex geometry electrical devices.

Applicants know of no prior art processes for preparing fibers, fiber masses and fiber reinforced composites from non-cystalline polymers wherein the fibers are formed from solution in a manner which facilitates the fabrication of self-reinforced insulating elements within intricate electrical components such as complex shaped transformers magnetic devices and/or capacitors.

SUMMARY OF THE INVENTION

In seeking to provide a method for preparing reinforcing fibers for use in composite material compositions serving as insulation in intricate electrical components, applicants have invented a process for forming a new class of polymeric fibers from solution. This process may be used to induce the formation of fibers from solutions of linear polymers which are essentially atactic and not highly crystalline. The process involves the seeding of a solution of the fiber forming polymer with a small amount of an isotactic, high molecular weight polyolefin, heating the mixture to effect dissolution of the polymers and then allow the mixture to cool under agitation.

The fibers are a combination of the seeding polymer and one or more other polymers which exhibit unique physical characteristics.

DETAILED DESCRIPTION

In the previous work described in U.S. Pat. No. 4,127,624, it was observed that fibers and fiber masses can be produced by sonic agitation of concentrated polymer solutions while cooling. Furthermore, it was observed that useful composites can be produced by forming the fibers and fiber masses from solution in a curable polymer or by secondary impregnation of the fibers and fiber masses with a curable resin. Fibers and fiber masses were prepared from polyethylene and from a variety of polyalkene polymers providing that the polymers possessed a high degree of crystallinity. Composites prepared from these fiber masses were shown to exhibit good mechanical properties, thermal resistance and dimensional stability on aging.

All of the previous work, however, was limited to the class of polymers defined as linear polyalkenes which have uniform symmetrical structures and are highly crystalline. Only one exception was noted in our previous work. Nylon 6, a noncrystalline, atactic polymer, was observed to form fibers in combination with isotactic, highly crystalline polypropylene. This behavior was attributed to the pronounced tendency of nylons to form fibers because of the strong hydrogen bonding between the molecules of this class of polymers.

We have discovered a new method of growing fibers and fibrous masses from polymeric material that employs a seeding concept. Utilizing our method it is possible to prepare fibers and fiber masses by stirring and other means of agitation from polymers that will not form fibers from solution by any known technique. The fiber masses and composites possess significant advantages over comparable prior art products.

Fiber forming materials which are useful in this invention are linear, organic polymers. The seed materials are high molecular weight organic polymers, having a regularly repeated chain structure and a high degree of crystallinity as determined by x-ray diffraction. The crystalline polymer, isotactic polypropylene, is particularly useful as a seeding polymer. We have successfully used our seeding invention to produce fibers and fiber masses consisting essentially of poly(acrylonitrile-butadiene-styrene) a terpolymer of ethylene, propylene and acrylic acid; isotactic 4-methyl-1-pentene; and several other polymeric materials. Generally, the seed polymer used in the above fiber mass formations was isotactic polypropylene of high molecular weight (average viscosity of 200,000). However, other seeding materials such as polyethylene and polymers taken from the group of isotactic, crystalline polyalkenes, such as isotactic polybutene, isotactic poly(4-methyl-1-pentene), will function as seeding polymers.

A solution of the seed polymer and of the polymer which does not normally form fibers by this method is formed. The solution will preferably contain about 2% to 20% by weight of the fiber forming and seed material, the upper limit being dictated by the limit of solubility of the fiber former. The ratio of seed polymer to fiber forming polymer may vary from 1% to 90% of the weight of the polymers in the solution.

The choice of solvents will depend upon various factors such as the nature of the solute and the final product to be obtained from the process. When one wants to isolate the fiber mass, then the solvents generally are in the xylene and toluene class of alkylbenzenes.

In general, it is necessary to heat the solvent in order to dissolve an adequate amount of the fiber forming and seed material therein. Temperatures ranging from 110° to 140° C. are adequate. The solution is then allowed to cool slowly while it is simultaneously subjected to a high stirring rate, which in turn creates an intense velocity gradient between the stirring rod and container, or to some other form of vigorous agitation, either mechanically or vibrationally induced. At some temperature range during the cooling and agitation, dependent upon the concentration, type of polymers, and solvents, an abundance of fibers will appear.

Fibers produced by stirring are usually attached to and spirally arranged around the stirrer. We therefore prefer to subject the cooling polymer solution to agitation produced by vibration in the sonic range whereby dense interconnected fibrous networks are formed. These networks we have generally referred to as fiber masses. By sonic range we mean vibrations having a cyclic frequency on the order of 20 to 20,000 hertz (Hz).

Other methods of agitation also produce fibers, for instance the submersion of an object in a cooling polymer solution while the object is shaken, vibrated, or subjected to a reciprocating motion of frequencies in the sonic range will cause fibers to be formed upon and attach to the object.

If the fiber mass is the desired product, the solvent may be removed by routine methods, the precise method being dictated by the nature of the solvent. For instance, a volatile solvent may be removed by simple evaporation. A relatively nonvolatile solvent can be washed out with a volatile liquid, the traces of which can then be evaporated. The resultant fibers or fibrous mass may then be impregnated with a curable resin to form a composite material having excellent physical, chemical and thermal resistance characteristics.

Our fibers and fiber masses have a variety of practical uses. They may be used in the formation of papers, cloth, felts, mats, nonwoven fabrics, cordage and the like. In addition, the masses may be broken up to provide individual fibers or fiber bundles which can also be used to form paper, felts, and similar products. They are useful in the formation of fiber-reinforced molded or cast products.

While it is possible to cause fibers to form from solutions having as little as 20% of the seeding polymer in solution with the target polymer, we found that seeding polymer concentrations of from 25% to 35% by weight to yield the best results insofar as out particular requirements for fiber masses were concerned.

Our studies further indicate that the concentrations of seeding material needed is dependent upon its molecular weight distribution. It is apparent that a small fraction of the higher molecular weight components of the seeding polymer initiate the formation of fibers, which in turn cause lower molecular weight components to come out as fibers along with fibers from the target polymer. This principle tends to suggest a seeding polymer selected from a very narrow high-molecular weight range to minimize the amount of seeding material required to initiate the formation of the desired polymeric mass.

While seeding polymers are not required to produce fibers from solutions of crystalline polymers we have discovered that the use of seeding polymers during fiber forming processes wherein crystalline polymers are used substantially increases the efficiency of the fiber forming processes.

Following are examples of this invention when applied to fiber forming polymers which either do not form, or form only with difficulty, fibers from solution by previous methods. These polymers however do meet the previous method criteria of isotacticity and crystallinity.

EXAMPLE I 0.70 g of isotactic poly(4-methypentene-1) with 0.30 g of isotactic polypropylene was placed into 15 ml. of styrene. The mixture was heated to 130° 140° C. to effect dissolution of the polymers. The solution was cooled while under highspeed stirring producing an abundance of fibers with a blue cast.

EXAMPLE II 0.70 g of isotactic poly(4-methylpentene-1), 0.15 g of isotactic polypropylene and 0.15 g of isotactic polybutene were dissolved in 15 ml. of styrene at 140° C. The solution was slowly cooled under vigorous stirring thus producing a large amount of loose fibers.

EXAMPLE III 0.70 g of isotactic polystyrene, lot #911-3, and 0.30 g of isotactic polypropylene were dissolved into 15 ml. of styrene inhibited with benzoquinone at about 140° C. The solution was cooled with good stirring to produce fibers.

EXAMPLE IV

To 30 ml. of styrene inhibited with benzoquinone was added 1.4 g of isotactic 4-methyl-1-pentene and 0.60 g of polypropylene. The mixture was dissolved at 135° C. then slowly cooled with good stirring. A large amount of fibrous mat was obtained, washed in acetone and dried.

The fibers formed on the stirring rod and in the solvent may be dispersed in a liquid using a high speed mixer or blender and separated by filtration.

The same systems as described in the examples may also be prepared as fiber masses by subjecting the cooling solution of polymers to low frequency sonic vibrations.

While the examples above disclose our invention as it is applied to the formation of isotactic poly(4 methylpentene-1) and isotactic polystyrene fibers, our polymeric seeding technique may be applied to form fibers from atactic, noncrystalline polymers as well. From our studies it can be concluded that a great number of soluble linear polymers can be caused to form fibers from a solution in which a seeding polymer has been added.

The determining factors in the selection of a seeding polymer appear to be a high degree of crystallinity, isotacticity or regular symmetrical structure and solubility in the same solvents as the fiber former. Following are examples of our invention applied to non-crystalline atactic polymers.

EXAMPLE V

To 40 ml. of xylene was added 0.28 g of high molecular weight, isotactic polypropylene and 2.52 g of a terpolymer consisting of acrylonitrile, butadiene and styrene. The mixture was heated to about 125° C. to dissolve both polymers then slowly cooled with rapid stirring to cause the formation of layers of fiber mats. The fiber mats were washed in methyl alcohol and dried.

EXAMPLE VI

To 40 ml. of styrene with 0.45 g benzoquinone added as an inhibitor, was added 3.8 g of XPA-1 (a copolymer of propylene and acrylic acid) and 0.2 g of isotactic polypropylene as the polymer seed. The mixture was heated to 140° C. to dissolve the polymers then slowly cooled under rapid stirring to about 30° C. The fiber mats were washed in acetone and dried.

EXAMPLE VII

Two grams of ABS (acrylonitrile-butadiene-styrene terpolymer) resin and 2 g of isotactic polypropylene were added to 40 ml. of xylene. The mixture was heated to 120° C. to effect dissolution, then with stirring slowly cooled to room temperature. The resulting fiber masses were washed with isopropyl alcohol and dried.

EXAMPLE VIII

A 50/50 w/w blend of highly crystalline polypropylene with polyvinylidene fluoride and tetrafluoroethylene-hexafluoropropylene-vinylidene fluoride terpolymer was dissolved in a solvent system to a 10% w/vol concentration. The solvent system consisted of a 57% 2 butanone, 15% acetone, 25% methyl isobutyl ketone, 2% cyclohexanone, and 1% diacetone alcohol mixture. A small amount non-solvent, water, was slowly introduced to the polymer solutions while subjecting them to vigorous sonic agitation at ambient temperature. This resulted in the formation of homogeneous fiber masses.

Having fully described our invention and provided teachings to enable others to make and utilize the same, the scope of our claims may now be understood as follows.

What is claimed is:

1. An improved process for precipitating fibers from solutions of non-crystalline organic polymers comprising:

(a) first providing a polymer-solvent solution by dissolving in a heated solvent a non-crystalline polymer and a linear isotactic crystalline polyalkene seeding polymer thereby forming a hot mixed polymer solvent solution, said solvent, when heated, being capable of dissolving both said non-crystalline polymer and said seeding polymer, and the ratio of said seeding polymer to said non-crystalline polymer being within the range of 1 to 90 percent of the weight of said polymers in said solutuion;

(b) subjecting said solution to vigorous agitation having a cyclic frequency within the range of 20 to 20,000 hertz; and (c) allowing said solution to slowly cool under said agitation whereby fibers precipitate therefrom.

2. The process of claim 1 wherein said seeding polymer is isotactic polypropylene or polyethylene and said non-crystalline polymer is selected from the group consisting of copolymers of propylene and acrylic acid, terpolymers of acrylonitrile-butadiene-styrene, and polymer blends of polyvinylidine fluoride and tetrafluoroethylene-hexafluoropropylene-vinylidene fluoride.

3. The process of claim 1 wherein said seeding polymer is isotactic polypropylene.

4. The process of claim 1 wherein said agitation is provided by sonic vibrations.

5. A process for forming fibers from hot solvent solutions comprising the steps of:

(a) providing a hot solution which includes a solvent capable of dissolving first and second selected polymers, said first polymer dissolved in said solvent and selected from the group consisting of propylene-acrylic acid copolymers, acrylonitrile-butadiene-styrene terpolymers and blends of polyvinylidene fluoride with a tetrafluoroethylene-hexafluoropropylene-vinylidene fluoride terpolymer, and said second polymer dissolved in said solvent to form a mixed polymer solution and selected from the group consisting of isotactic polypropylene, isotactic polybutene, isotactic poly(4-methyl-1-pentene,) and polyethylene, wherein the ratio of said second polymer to said first polymer is within the range of 1 to 90 percent of the weight of said polymers in said solution; and (b) agitating said mixed polymer solution with a reciprocating or oscillatory motion having a cyclic frequency within the range of 20 to 20,000 hertz, while simultaneously lowering the temperature of said solutions to precipitate fibrous masses therefrom.

6. The process of claim 5 wherein said first polymer is an acrylonitrile-butadiene-styrene terpolymer.

7. The process of claim 5 wherein said first polymer is selected from blends consisting of polyvinylidene fluoride and tetrafluoroethylene-hexafluoropropylene-vinylidene fluoride terpolymers.

8. A process for forming fibers from hot solvent solutions comprising the steps of:

(a) providing a hot solution which includes xylene having dissolved therein an acrylonitrile-butadiene-styrene terpolymer and isotactic polypropylene, wherein the ratio of said polypropylene to said terpolymer is within the range of 1 to 90 percent of the weight of said polypropylene and said terpolymer in said solution; and (b) agitating said solution with a reciprocating or oscillatory motion having a cyclic frequency within the range of 20 to 20,000 hertz, while simultaneously lowering the temperature of said solutions to precipitate fibrous masses therefrom.

9. A process for forming fibers from hot solvent solutions comprising the steps of:

(a) providing a hot solution which includes a mixed ketone solvent having dissolved therein a blend of polyvinylidene fluoride and a tetrafluoroethylene-hexafluoropropylene-vinylidene fluoride terpolymer and isotactic polypropylene, wherein the ratio of said polypropylene to said blend is within the range of 1 to 90 percent of the weight of said polypropylene and said blend in said solution; and (b) agitating said solution with a reciprocating or oscillatory motion having a cyclic frequency within the range of 20 to 20,000 hertz, while simultaneously lowering the temperature of said solutions to precipitate fibrous masses therefrom.

* * * * *